US010407270B2

(12) United States Patent
Wu

(10) Patent No.: US 10,407,270 B2
(45) Date of Patent: Sep. 10, 2019

(54) PRESS STRUCTURE FOR PRESS TYPE STATIONERY

(71) Applicant: QUANZHOU YIYANG TWINGO STATIONERY CO., LTD., Fujian (CN)

(72) Inventor: Hang Wu, Fujian (CN)

( * ) Notice: Subject to any disclaimer, the term of this patent is extended or adjusted under 35 U.S.C. 154(b) by 351 days.

(21) Appl. No.: 15/504,657

(22) PCT Filed: Nov. 9, 2015

(86) PCT No.: PCT/CN2015/094085

§ 371 (c)(1),
(2) Date: Feb. 17, 2017

(87) PCT Pub. No.: WO2017/079865

PCT Pub. Date: May 18, 2017

(65) Prior Publication Data

US 2017/0275127 A1 Sep. 28, 2017

(51) Int. Cl.

| | |
|---|---|
| ***B43K 7/12*** | (2006.01) |
| ***B65H 37/00*** | (2006.01) |
| ***B43K 24/08*** | (2006.01) |
| ***B43K 24/18*** | (2006.01) |
| ***B43K 29/05*** | (2006.01) |

(52) U.S. Cl.

CPC ..... *B65H 37/007* (2013.01); *B43K 24/08* (2013.01); *B43K 24/084* (2013.01); *B43K 24/086* (2013.01); *B43K 24/088* (2013.01); *B43K 24/186* (2013.01); *B43K 29/05* (2013.01)

(58) Field of Classification Search

CPC .... B43K 24/08; B43K 24/084; B43K 24/086; B43K 24/088; B43K 24/186

USPC ..... 401/109

See application file for complete search history.

(56) References Cited

U.S. PATENT DOCUMENTS 3,334,615 A * 8/1967 Bross ..... B43K 24/084 401/110
3,814,524 A * 6/1974 Sperti ..... B05B 11/0035 401/110
4,343,559 A * 8/1982 Silver ..... B43K 24/08 401/109

FOREIGN PATENT DOCUMENTS

EP 0293343 A1 * 11/1988 ..... B43K 7/005

* cited by examiner

*Primary Examiner* — Jennifer C Chiang
(74) *Attorney, Agent, or Firm* — Prakash Nama; Global IP Services, PLLC

(57) ABSTRACT

A press structure for a press type stationery, having mounting board (1), a button (400) and a resilient piece. The mounting board has a recess (11). A position limiting block (12) is provided at the front surface of the mounting board in this recess. A closed loop sliding track is formed between outer walls of the position limiting block and inner walls of the recess. The resilient piece has a spring (2) and a resilient rod (3). The position limiting block has a first inclined surface (122) and a second inclined surface (123). End portions of the first and second inclined surfaces are at one side of the resilient rod; upper ends of the first and second inclined surfaces are at another opposite side of the resilient rod. A contact part (4) positioned within the sliding track is provided at an upper end portion of the resilient rod.

7 Claims, 10 Drawing Sheets

PRESS STRUCTURE FOR PRESS TYPE STATIONERY

BACKGROUND OF THE INVENTION

The present invention relates to a kind of press structure for stationery. More specifically, the present invention relates to a press structure for controlling a writing tip of a press type retractable pen or a press side of a press type correction tape to extend out of or retracted back to a housing.

Press type retractable pen and press type correction tape are two major types of press type stationery now available in the market. A writing tip of a press type retractable pen or a press side of a press type correction tape can be extended out of or retracted back to a housing by pressing a button. As such, the writing tip of the press type retractable pen or the press side of the press type correction tape can be held inside the housing when they are not in use. Accordingly, they will not be contaminated by dust in the environment which may disable them to function properly.

Nowadays, a press type retractable pen or a press type correction tape has a press structure which is commonly known as follows: FIGS. 1-2 give an example of a commonly known press structure of a press type correction tape, comprising a mounting board 100, a torsion spring and a button. The mounting board 100 is moveably mounted in a housing so as to be slidable along a direction along which the press side of the correction tape extends and retracts. A first end of the button is mounted in the housing and is slidable along a direction along which the press side of the correction tape extends and retracts. The first end of the button is connected with the mounting board for simultaneous movement with mounting board. A second end of the button extends out of the housing. The press side of the correction tape is mounted at a first end of the mounting board 100. The button is mounted at a second end of the mounting board 100. The torsion spring is fixedly mounted on the housing, and a first arm of the torsion spring is fixedly provided and cooperates with another side of the mounting board. A second arm of the torsion spring extends to the second end of the mounting board. A sliding track 101 is recessed on said another side of the mounting board 100 for an end portion of the second arm of the torsion spring to extend thereinto and slide within the sliding track 101 along with the movement of the mounting board 100. Also, a position limiting block 102 is provided inside the sliding track 101. The end portion of the second arm of the torsion spring is fixed on the position limiting block 102 when a working section of the press side extends out of the housing. A top surface of the position limiting block 102 is recessed to form a position fixing recess 102*a* at which the second arm of the torsion spring is hooked. A V-shape guiding block 101*a* corresponding to the position fixing recess 102*a* is protruded into the sliding track 101. According to this press structure, in order that the end portion of the second arm of the torsion spring can slide within the sliding track 101, a first guiding terrace 103, a second guiding terrace 104, a third guiding terrace 105 and a fourth guiding terrace 106 all capable of contacting an end surface of the second arm of the torsion spring must be provided inside the sliding track 101. Given that a pressing movement of the button can be considered as a movement of pressing the button from up to down, the first guiding terrace 103 is an upwardly inclined surface positioned at a right side of the position limiting block 102. The second guiding terrace 104 is a downwardly inclined surface, and the second guiding terrace 104 is lower than a first guiding terrace 103 along a thickness direction of the mounting board. The third guiding terrace 105 is an upwardly inclined surface. The third guiding terrace 105 is lower than the second guiding terrace 104 along a thickness direction of the mounting board. The second guiding terrace 104 and the third guiding terrace 105 are positioned at a top side of the position limiting block 102. A lower end of the second guiding terrace 104 and a lower end of the third guiding terrace 105 are both positioned within the position fixing recess 102*a*. A bottom of the position fixing recess 102*a* is positioned at the third guiding terrace 105. The fourth guiding terrace 106 is a downwardly inclined surface. The fourth guiding terrace 106 is higher than the first guiding terrace 103 along a thickness direction of the mounting board. The fourth guiding terrace 106 is positioned at a left side of the position limiting block 102. An axial line of the second arm of the torsion spring is positioned at a left side of the bottom of the position fixing recess 102*a*.

When the button is pressed downwardly, the mounting board 100 is moved downwardly, the first arm of the torsion spring is pressed downwardly and deformed. Along with the downward movement of the mounting board 100, the position limiting block 102 presses against the second arm of the torsion spring, such that the second arm of the torsion spring is deflected to the right side. As the mounting board 100 moves downwardly, frictional engagement between the end portion of the second arm of the torsion spring and the first guiding terrace 103 causes the end portion of the second arm of the torsion spring to move upward with frictional engagement along the first guiding terrace 103. When the end portion of second arm of the torsion spring is moved up to the second guiding terrace 104, the position limiting block 102 releases its pressing force against the second arm of the torsion spring, thus the second arm of the torsion spring resets its position to the left and moves directly within the second guiding terrace 104. Release the button such that the first arm of the torsion spring resets it position upwardly and the mounting board 100 will then follow to move upwardly. As the mounting board 100 moves upwardly, the second arm of the torsion spring frictionally engages the second guiding terrace 104, and slides with frictional engagement along the second guiding terrace 104 into the third guiding terrace 105, and then hooks at the bottom of the position fixing recess 102*a*. In this situation, the press side of the correction tape is fixedly extended out of the housing. When the button is pressed again, the first arm of the torsion spring is pressed downwardly and deformed, the mounting board 100 is moved downwardly again, the second arm of the torsion spring is pressed against by the V-shape guiding block 101*a* such that the second arm is deflected to the left, and then the second arm of the torsion spring slides from the third guiding terrace 105 to the fourth guiding terrace 106. As the button is released, the first arm of the torsion spring resets its position upwardly, the mounting board 100 will also move upwardly. By means of the reset in position of the second arm of the torsion spring, the second arm of the torsion spring moves with frictional engagement along the fourth guiding terrace 106 to the first guiding terrace 103. In this situation, the press side is fixed retracted back to the housing. According to the operation principle described above, upward and downward movement of the mounting board 100 will cause the end portion of the second arm of the torsion spring keep rubbing the plurality of guiding terraces due to frictional engagement. Over a long period of use, an intermediate terrace surface between the third guiding terrace 105 and the fourth guiding terrace 106 will be easily abraded away. If this happens, when the button is pressed downwardly, the second arm of the torsion spring will not be able to move to the fourth guiding terrace 106, and will therefore slide back to the third guiding terrace 105. Accordingly, the mounting board cannot reset its position, and thus resulting in operation failure of the press structure. Normally, such failure occurs after the button is pressed around 100 times, representing a short service life. Further, the mounting board has a complicated structure which is not easy to be constructed because of the plurality of guiding terraces.

BRIEF SUMMARY OF THE INVENTION

An object of the present invention is to provide a press structure for press type stationery. Such a press structure has a long service life allowing more than 500 times of pressing. Also, the mounting board of such a press structure has a simple structure.

The present invention provides the following technical solution to attain the above object:

A mounting board is mounted in a stationery housing and is reciprocally translatable in the stationery housing; a resilient piece is fixedly provided; with reference to a vertical direction along which the mounting board moves up and down, an end portion of an upper end of the mounting board is cooperatively connected with a button; the button partially extends out of the stationery housing; an upper part of a front surface of the mounting board or an upper part of a back surface of the mounting board is recessed to form a recess; a position limiting block is provided in the recess; a closed loop sliding track is formed between outer walls of the position limiting block and inner walls of the recess; a top side of the position limiting block is recessed downwardly to form a position fixing slot; the resilient piece comprises a spring that is vertically deformable along with a downward movement of the mounting board and a resilient rod laterally deformable along with the downward movement of the mounting board; the mounting board is cooperatively connected with the spring in a manner that compression of the spring is controlled along with the downward movement of the mounting board; the resilient rod is upright positioned along the vertical direction; two sides of the position limiting block are provided with a first inclined surface and a second inclined surface respectively; the first inclined surface and the second inclined surface are inclined towards the same side; an end portion of a lower end of the first inclined surface and an end portion of a lower end of the second inclined surface are both positioned at one side of the resilient rod; an upper end of the first inclined surface and an upper end of the second inclined surface are both at another opposite side of the resilient rod; the position fixing slot is positioned between the upper end of the first inclined surface and the upper end of the second inclined surface; an end portion of an upper end of the resilient rod has a contact part; the contact part is positioned inside the sliding track and slidably contacts and cooperates surface-to-surface with the first inclined surface and the second inclined surface as the mounting board moves downwardly.

The mounting board is provided with a position limiting blocking piece at a top surface of the sliding track; the position limiting blocking piece protrudes downwardly towards the position fixing slot; an end portion of a lower end of the position limiting blocking piece is positioned inside the position fixing slot.

The position limiting blocking piece has a V shape.

The spring is a torsion spring; the torsion spring is fixedly mounted on the stationery housing; a pressing block is provided protruding out from the mounting board and positioned above a first arm of the torsion spring; a second arm of the torsion spring extends horizontally along a lateral direction of the mounting board; an end portion of the second arm of the torsion spring is upwardly extended with an extension arm perpendicular to the second arm of the torsion spring; the extension arm is the resilient rod; the contact part is a transverse rod; the transverse rod is positioned at an end portion of an upper end of the extension arm and is perpendicular to the extension arm; the transverse rod extends along a direction corresponding to a thickness of the mounting board.

The spring is a cylindrical spring; the cylindrical spring extends along the vertical direction of the mounting board; the cylindrical spring is fixedly mounted on the stationery housing; a press block is correspondingly provided on and protruding out from the mounting board; the press block is positioned at an end portion of an upper end of the cylindrical spring; an end portion of a lower end of the cylindrical spring has an upwardly extending extension arm; the extension arm is the resilient rod; the contact part is a transverse rod; the transverse rod is positioned at an end portion of an upper end of the extension arm and is perpendicular to the extension arm; the transverse rod extends along a direction corresponding to a thickness of the mounting board.

The spring is a cylindrical spring; the cylindrical spring extends along the vertical direction of the mounting board; the cylindrical spring is fixedly mounted on the stationery housing; a press block is correspondingly provided on and protruding out from the mounting board; the press block is positioned at an end portion of an upper end of the cylindrical spring; the resilient rod is a plastic elastic rib extending along the vertical direction of the mounting board; an end portion of a lower end of the plastic elastic rib is fixed on the stationery housing; a contact piece is protruded at an end portion of an upper end of the plastic elastic rib; the contact piece is the contact part; a first guiding inclined surface cooperatively in contact with the first inclined surface and a second guiding inclined surface cooperatively in contact with the second inclined surface are provided on the contact piece.

The spring is a cylindrical spring; the cylindrical spring is positioned below the mounting board; end portions of two ends of the cylindrical spring are both positioned at a lower end of the cylindrical spring; an end portion of a first end of the cylindrical spring is cooperatively fixed with the stationery housing; an end portion of a second end of the cylindrical spring has an extension arm that extends upwardly; the extension arm is the resilient rod; the contact part is a transverse rod; the transverse rod is formed at an end portion of an upper end of the extension arm; the transverse rod is perpendicular to the extension arm, and extends along a direction corresponding to the thickness of the mounting board.

According to the press structure for press type stationery of the present invention disclosed above, when the button is pressed downwardly, the mounting board will also move downwardly; downward movement of the mounting board will compress the spring, and the first inclined surface of the position limiting block will contact with the contact part of the resilient rod; as the mounting board continues to move downwardly, the contact part will lead to deflection of the resilient rod to the left or to the right because of the first inclined surface; when the contact part passes over the first inclined surface, the resilient rod is released from pressure and will reset its position to the right or to the left; release the button to reset the spring, and the mounting board will move upwardly; due to the upward movement of the mounting board and the reset of the resilient rod, the contact part will fall into the position fixing slot and being limited therein by an inner side wall of the position fixing slot; as such, the mounting board stops moving upward, and the component connected at the lower end of the mounting board can be fixedly extended out of the stationery housing; also, the lower end of the first inclined surface and the lower end of the second inclined surface are both at one side of the resilient rod, that is either the left or the right side of the resilient rod, while the upper end of the first inclined surface and the upper end of the second inclined surface are both at another opposite side of the resilient rod, that is either the right side of the resilient rod if the lower ends of the first inclined surface and the second inclined surface are on the left side, or the left side of the resilient rod if the lower ends of the first inclined surface and the second inclined surface are on the right side; accordingly, the central axis of the resilient rod is deviated from a side of the position fixing slot; as such, the contact part is still to a certain extent deflected to the left or to the right and does not completely reset its position when the contact part is limited by the inner side wall of the position fixing slot; when the button is pressed downwardly again, the spring is compressed again; downward movement of the mounting board causes the contact part to be positioned above the position fixing slot; as such, the contact part is freed from the position fixing slot, and thus causing the resilient rod to completely reset its position to the right or to the left; as the resilient rod resets its position completely, the contact part will be positioned above a top part of the second inclined surface; when the button is released, the spring resets its position and the mounting board will move upwardly; upward movement of the mounting board causes the contact part to contact with the second inclined surface; due to the inclination of the second inclined surface, the resilient rod will deflect to the right or to the left along with the upward movement of the mounting board; when the contact part passes over the bottom side of the second inclined surface, the resilient rod will be completed released from its deflection and resets to the left or to the right back to its initial position; accordingly, the component connected to the lower end of the mounting board will be fixedly retracted inside the stationery housing. Compared with prior arts, positional relationships between the resilient rod, the position limiting block and the position fixing slot makes it possible for the contact part to slide within the sliding track attainable by the resilience of the resilient rod alone. It is not necessary to rely on frictional engagement with the inner bottom surface of the sliding track in order to slide the contact part within the sliding track. Therefore, the present invention prevents the problem of mechanical failure of the press structure due to abrasive damage of the inner bottom surface of the sliding track in a conventional press structure. The service life of the present invention is increased, allowing pressing of the press structure for more than 500 times. Also, it is not necessary to provide any guiding terraces inside the sliding track. Therefore, the mounting board has a simpler structure and is easier to be configured. Further, contacts between the contact part and the position limiting block are surface-to-surface contact enabling large contact surface area so that the contact part will inflict lesser abrasive damage to the position limiting block.

DETAILED DESCRIPTION OF THE INVENTION

The present invention is further described in detail below with reference to some embodiments, so that the technical solution of the present invention is further being understood.

Figure 1:
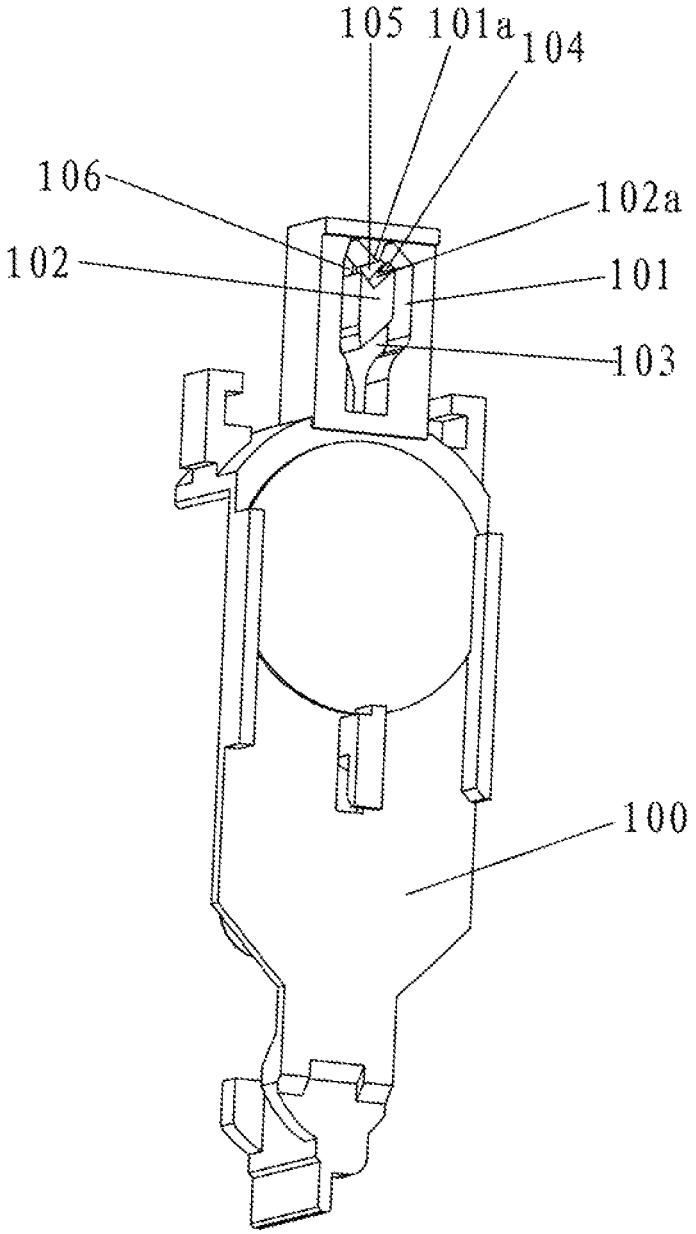
FIG.1 PRIOR ART
FIG. 1 is a structural view showing a mounting board of a press structure of a conventional press type correction tape.
Figure 2:
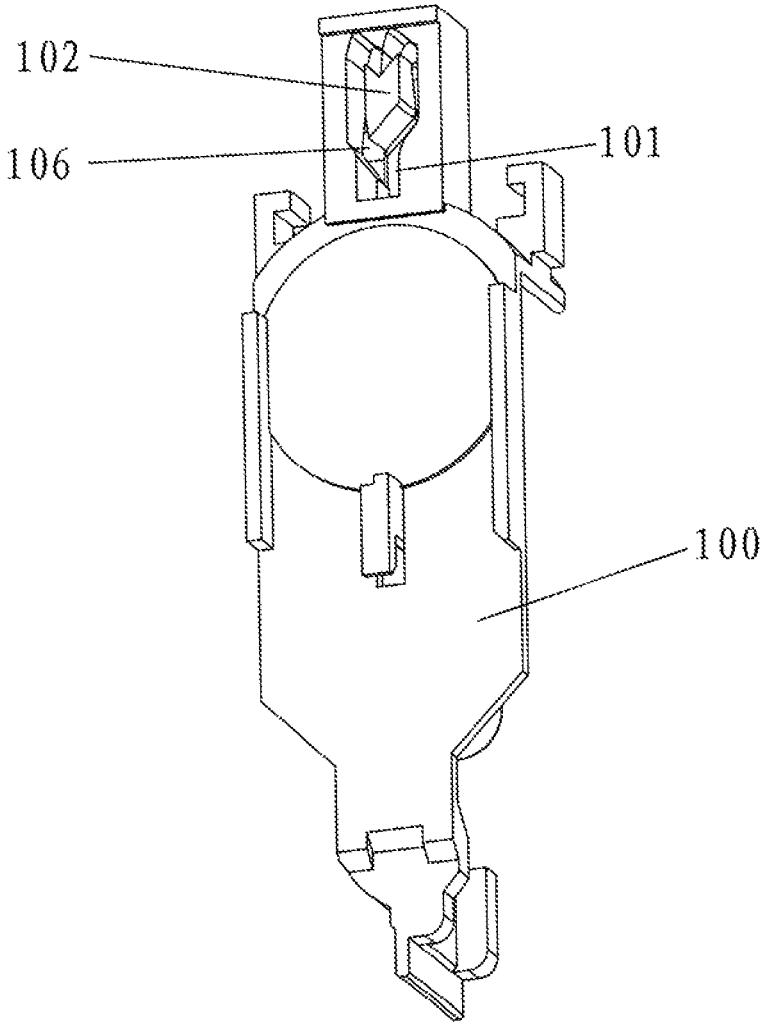
FIG.2 PRIOR ART
FIG. 2 is another angle of the structural view showing the mounting board of the press structure of the conventional press type correction tape.
Figure 3:
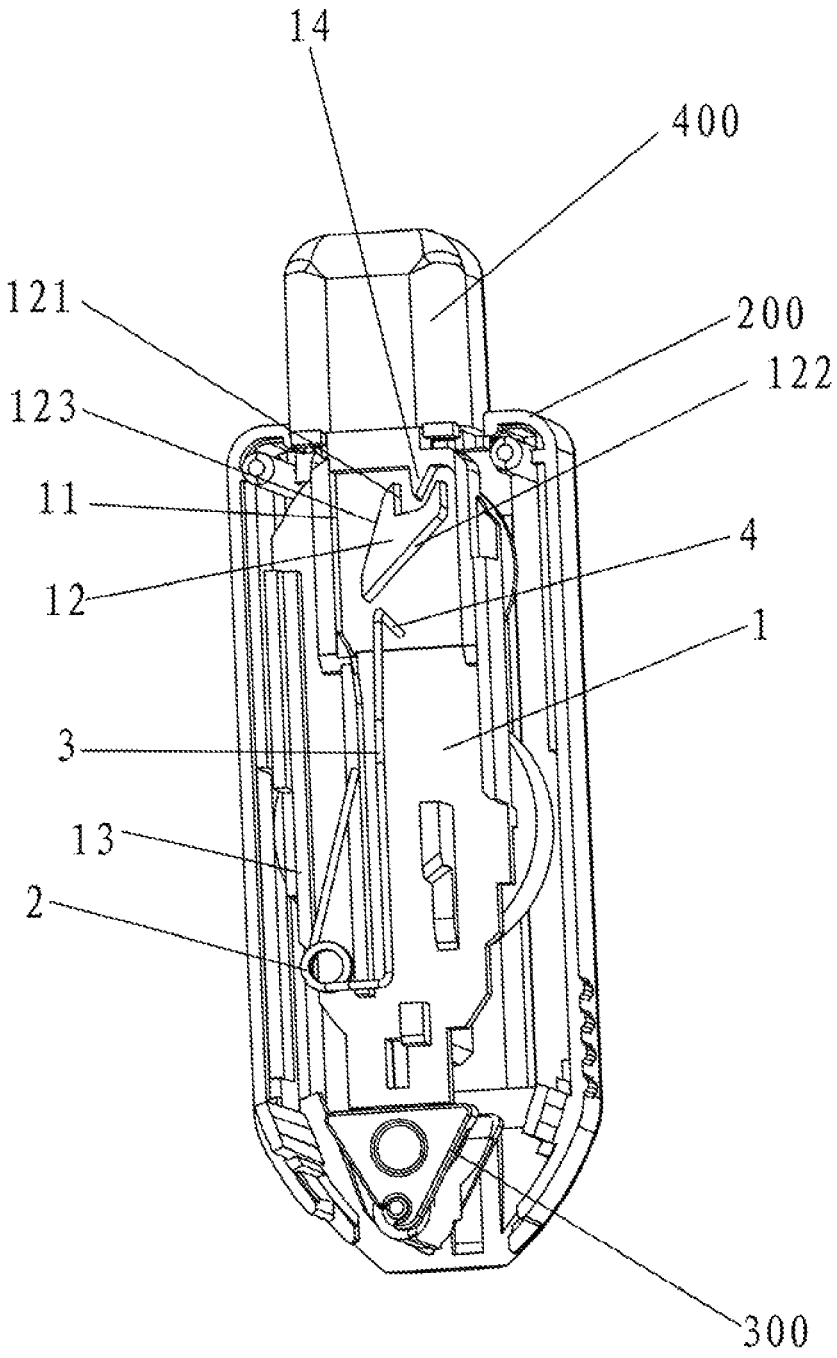
FIG. 3 is a structural view of embodiment 1.
Figure 4:
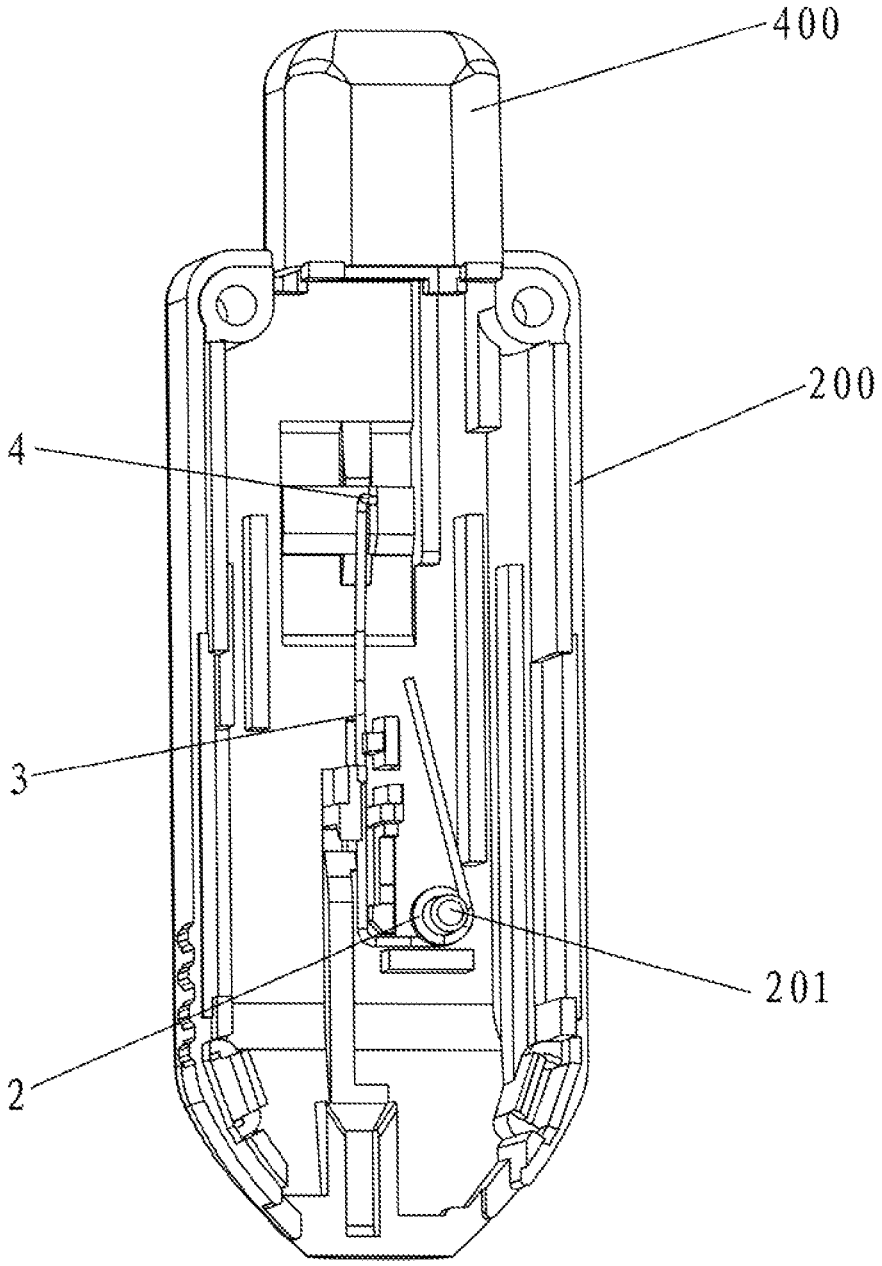
FIG. 4 shows a structure of embodiment 1 where a resilient piece is mounted.

A first embodiment of a press structure of a press type stationery according to the present invention is shown in FIGS. 3-4, comprising a mounting board 1 and a resilient piece; the mounting board 1 is movably mounted within a stationery housing; in this embodiment, the stationery housing is a correction tape housing 200; the mounting board 1 of this embodiment is mounted in the same manner as the mounting board of a conventional pen shaped correction tape, therefore the mounting method of the mounting board 1 of this embodiment will not be repeated here. With reference to a vertical direction along which a tape tip 300 of the correction tape retracts and extends, an upper end of the mounting board 1 is provided with a button 400 which has an upper part extending out of the stationery housing 200; an upper part of a front surface of the mounting board 1 is recessed to form a recess 11; a position limiting block 12 is provided in the recess at the front surface of the mounting board 1; a closed loop sliding track is formed between outer walls of the position limiting block 12 and inner walls of the recess 11; a middle section of a top side of the position limiting block 12 is recessed downwardly to form a position fixing slot 121.

The present invention has the following inventive features: the position limiting block 12 has a first inclined surface 122 and a second inclined surface 123 positioned on a left side and a right side of the position limiting block 12 respectively; the first inclined surface is an upwardly inclined surface wherein an upper end of the of the first inclined surface 122 is positioned to the right of a lower end of the first inclined surface 122; the second inclined surface is also an upwardly inclined surface; the first inclined surface 122 and the second inclined surface 123 are inclined towards the same side; the position fixing slot 121 is positioned between the upper end of the first inclined surface 122 and a upper end of the second inclined surface 123.

The resilient piece comprises a spring 2 that is vertically deformable along with a downward movement of the mounting board 1 and a resilient rod 3 laterally deformable along with the downward movement of the mounting board 1; the resilient rod 3 is upright positioned along a vertical direction; the lower end of the first inclined surface 122 and a lower end of the second inclined surface 123 are positioned at a left side of and above the resilient rod 3; the upper end of the first inclined surface 122 and the upper end of the second inclined surface 123 are both at a right side of the resilient rod 3; in other words, a central axis of the resilient rod 3 is positioned at a left side of the position fixing slot 121; an end portion of an upper end of the resilient rod 3 has a contact part 4; the contact part 4 is positioned inside the sliding track and slidably contacts and cooperates surface-to-surface with the first inclined surface 122 or the second inclined surface 123 as the mounting board 1 moves downwardly; both the central axis of the resilient rod 3 and a lower part of the second inclined surface 123 are positioned at the left side of the position fixing slot 121; an upper part of the second inclined surface 123 and the position fixing slot 12 are positioned at a right side of the central axis of the resilient rod 3; preferably, the spring 2 is a torsion spring; this torsion spring is fixedly mounted on an inner surface of a front side of the correction tape housing 200; in particular, a position fixing rod 201 is provided on the inner surface of the front side of the correction tape housing 200, the torsion spring sleeves onto the position fixing rod 201; a first arm of the torsion spring is inclined upwardly, or is inclined downwardly; a second arm of the torsion spring extends horizontally along the lateral direction of the mounting board 1; a pressing block 13 is provided protruding out from the mounting board 1 and pressing against the first arm of the torsion spring; an end portion of the second arm of the torsion spring is upwardly extended with an extension arm perpendicular to the second arm of the torsion spring; the extension arm is the resilient rod 3; the contact part 4 is a transverse rod; this transverse rod is positioned at an end portion of an upper end of the extension arm and is perpendicular to the extension arm; the transverse rod extends along a direction corresponding to a thickness of the mounting board 1.

The mounting board 1 is provided with a position limiting blocking piece 14 at a top surface of the sliding track; the position limiting blocking piece 14 protrudes downwardly towards the position fixing slot 121; the position limiting blocking piece 14 has a V shape, and a pointed end of the position limiting blocking piece 14 is positioned inside the position fixing slot 121.

According to the press structure of a press type stationery disclosed by the present invention, when the button 400 is pressed downwardly for the first time, the mounting board 1 will move downwardly; downward movement of the mounting board 1 causes the first arm of the torsion spring to be pressed and thus deformed due to downward movement of the pressing block 13, and the lower end of the first inclined surface 122 of the position limiting block 12 will have surface contact with the contact part 4; as the mounting board 1 continues to move downwardly, the upper end of the first inclined surface 122 will move downwardly; downward movement of the upper end of the first inclined surface 122 forces the contact part 4 rightward, and thus the resilient rod 3 will be deflected rightward as well; as the upper end of the first inclined surface 122 passes over the contact part 4, the contact part 4 releases its contact with the first inclined surface 122, and thus the resilient rod 3 is free from the force that deflects the resilient rod 3 rightward, and so the resilient rod 3 resets its position leftward; as the resilient rod 3 resets its position leftward, the contact part 4 will be limited by the position limiting blocking piece 14 so as not to completely resets its position to the left. When the button 400 is released, the first arm of the torsion spring is released from pressing force and thus resets its position upward; as the first arm of the torsion spring resets its position upward, the mounting board 1 is pushed upward; upward movement of the mounting board 1 separates the contact part 4 from the position limiting blocking piece 14; the resilient rod 3 continues to reset its position leftward, while the position fixing slot 121 will be moved upward to where the contact part 4 is positioned, and so the contact part 4 will be situated in the position fixing slot 121, and the contact part 4 will be limited not to further deflect leftward by an inner left wall of the position fixing slot 121; as such, the contact part 4 is limited within the position fixing slot 121 and hooked at a bottom surface of the position limiting slot 121, and the mounting board 1 is limited not to move further upward. At this moment, the tape tip 300 installed at a lower end of the mounting board 1 is fixedly extended out of the correction tape housing 200; also, as the central axis of the resilient rod 3 is positioned on the left side of the position fixing slot 121, the resilient rod 3, when positioned in the position fixing slot 121 and being limited by the inner left wall of the position fixing slot 121, is still subject to rightward pressure and is not completely reset to the left. When the button 400 is pressed for the second time, the first arm of the torsion spring is being compressed once again, and the mounting board 1 will move downwardly; downward movement of the mounting board 1 causes the position fixing slot 121 to be positioned below the contact part 4, the contact part 4 is thus released from limitation of the position fixing slot 121, and so the resilient rod 3 continues to reset leftward until it completely resets its position; the contact part 4 is now positioned above a top part of the second inclined surface 123. When the button is released 400, the first arm of the torsion spring resets its position, and the mounting board 1 will move upwardly; upward movement of the mounting board 1 results in the contact between the contact part 4 and the second inclined surface 123; as described above, the second inclined surface 123 is a downwardly inclined surface, and the upper end of the second inclined surface 123 is positioned to the right of the lower end of the second inclined surface 123, therefore when the mounting board 1 moves upwardly, the contact part 4 is pressed to the left by a lower part of the second inclined surface 123; the resilient rod 3 thus deflects to the left; when the lower end of the second inclined surface 123 is moved to position above the contact part 4, the resilient rod 3 is free from the second inclined surface and resets to the right; as the resilient rod 3 resets its position, the contact part 4 also restores its initial position; the first arm of the torsion spring abuts against the mounting board 1, and the tape tip 300 installed on the mounting board 1 is fixedly retracted back into the correction tape housing 200. Compared with prior arts, positional relationships between the resilient rod 3, the position limiting block 12 and the position fixing slot 121 makes it possible for the contact part 4 to slide within the sliding track attainable by the resilience of the resilient rod 3 alone. It is not necessary to rely on frictional engagement with the inner bottom surface of the sliding track in order to slide the contact part within the sliding track. Therefore, the present invention prevents the problem of mechanical failure of the press structure due to abrasive damage of the inner bottom surface of the sliding track in a conventional press structure. The service life of the present invention is increased, allowing pressing of the press structure for more than 500 times. Also, it is not necessary to provide any guiding terraces inside the sliding track. Therefore, the mounting board has a simpler structure and is easier to be configured. Also, abrasive damage done to the inner bottom surface of the sliding track will not lead to mechanical failure of the press structure. Further, contacts between the contact part 4 and the position limiting block 12 and the position limiting blocking piece 14 are surface-to-surface contact enabling large contact surface area so that lesser abrasive damage is done between the contact part 4 and the position limiting block 12 and the position limiting blocking piece 14; thus no mechanical failure of the press structure will be resulted. Besides, the position limiting blocking piece 14 can guarantee that the contact part 4 will always fall into the position fixing slot 121. Accordingly, the contact part 4 is prevented from passing over the position fixing slot 121 and directly sliding to the second inclined surface 123 when the resilient rod 3 resets its position. The V shape configuration of the position limiting blocking piece 14 can also provide guiding effect for the contact part 4 to slide into the position fixing slot 121.

The press structure of the embodiment described above is generally applied to a press type correction tape.

Figure 5:
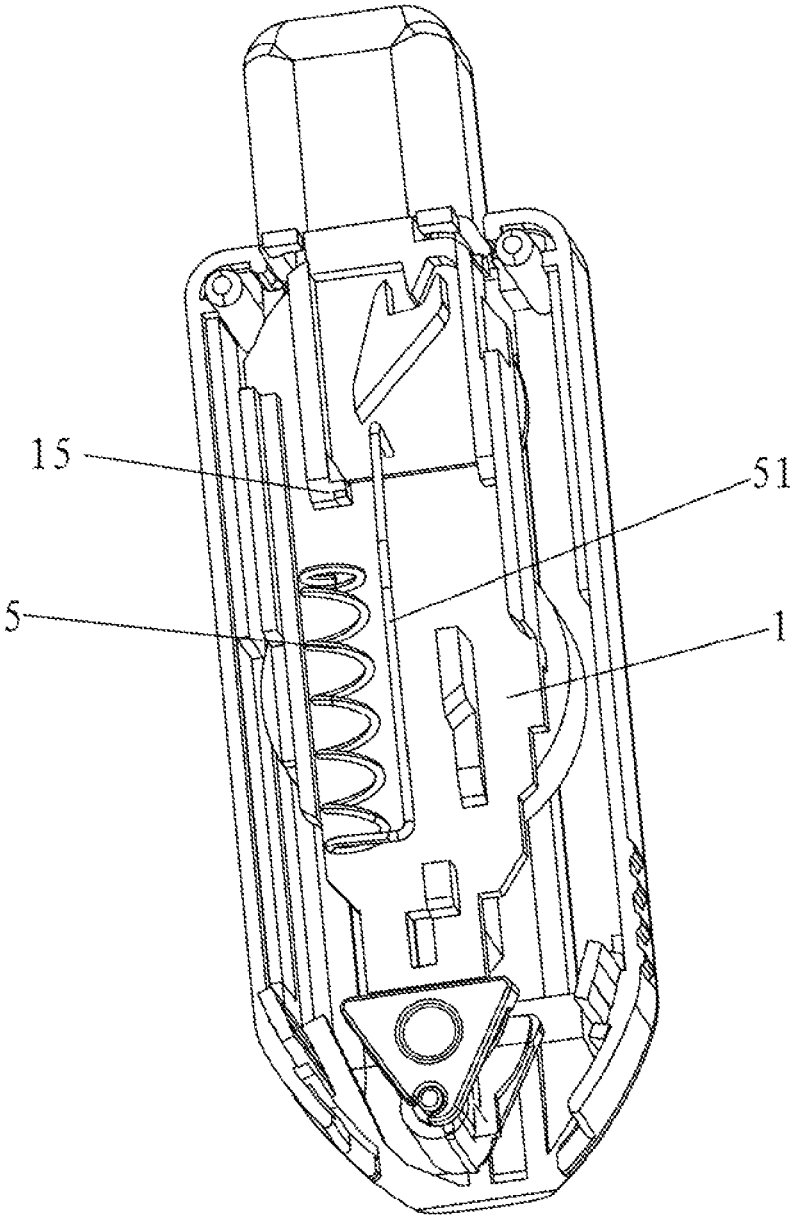
FIG. 5 is a structural view of embodiment 2.

A second embodiment of the press structure for press type stationery is shown in FIG. 5. The second embodiment is different from the first embodiment only with respect to the spring. In particular, the spring is a cylindrical spring 5; a mounting cylinder for sleeving, fixing and mounting the cylindrical spring is provided on an inner surface of the correction tape housing; the cylindrical spring 5 extends along a vertical direction of the mounting board 1; a press block 15 is fixedly and correspondingly provided on the mounting board 1; the press block 15 is positioned at an end portion of an upper end of the cylindrical spring 5; when the mounting board 1 moves downwardly, the press block 15 presses tightly against the cylindrical spring 5; the press block. 15 works according to the same pressing principle as how the pressing block presses against the first arm of the torsion spring in the first embodiment. An end portion of a lower end of the cylindrical spring 5 has an upwardly extending extension arm 51; this extension arm 51 is the resilient rod; the contact part of the second embodiment has the same structure as the contact part of the first embodiment. The cylindrical spring used in the second embodiment can likewise achieve the same functions as the torsion spring in the first embodiment, and so will not be repeated herein.

The press structure of the embodiment described above is generally applied to a press type correction tape.

Figure 6:
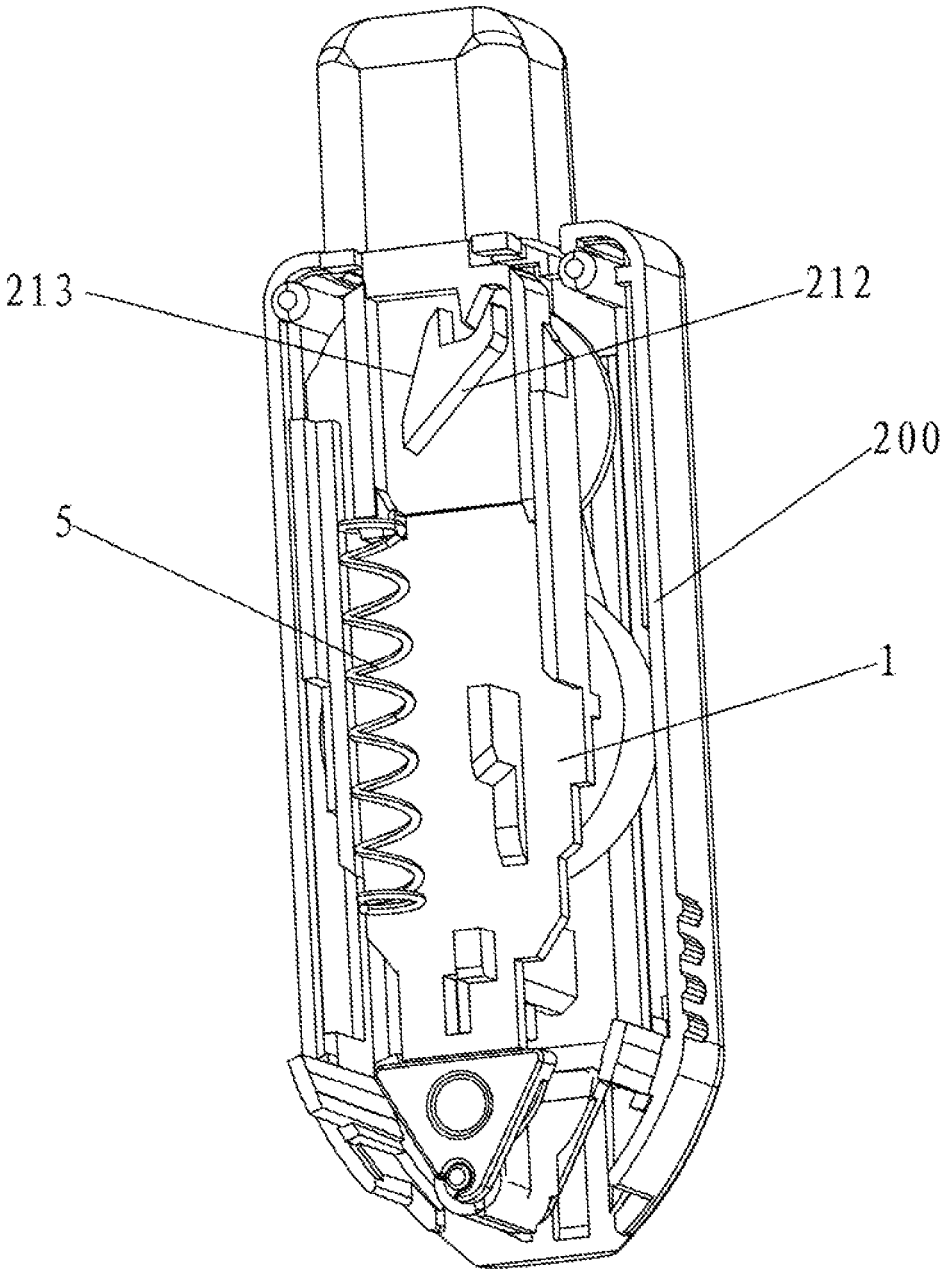
FIG. 6 is a structural view of embodiment 3.
Figure 7:
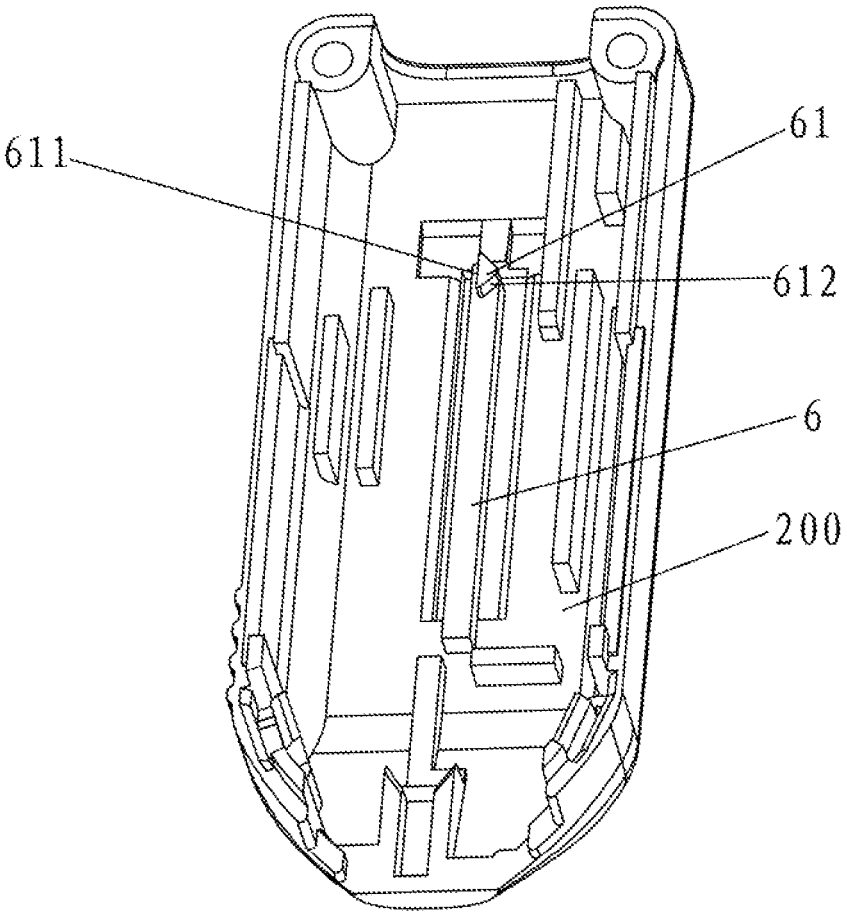
FIG. 7 shows a structure of embodiment 3 where the resilient rod is positioned on a correction tape housing.

A third embodiment of the press structure for press type stationery is shown in FIG. 6 and FIG. 7. The third embodiment is different from the second embodiment only with respect to the structures of the resilient rod and the contact part. In the third embodiment, the spring is also a cylindrical spring 5. In particular, the resilient rod is a plastic elastic rib 6 extending along a vertical direction of the mounting board 1; the plastic elastic rib 6 is a rod made of plastic material; the plastic elastic rib 6 is elastically deformable due to the elasticity of plastic; the plastic elastic rib 6 is disposed separately from the cylindrical spring; the plastic elastic rib 6 is formed in one piece at an inner side surface of the correction tape housing 200; a contact piece 61 stretching into the sliding track is protruded at an end portion of an upper end of the plastic elastic rib 6; this contact piece 61 is equivalent to the contact part described in the first embodiment; a left side of the contact piece 61 is provided with a first guiding inclined surface 611 capable of surface contacting and cooperating with a first inclined surface 212; a lower part of a right side of the contact piece 61 is provided with a second guiding inclined surface 612 capable of surface contacting and cooperating with a second inclined surface 213; cooperation between the plastic elastic rib 6 and the contact piece 61 can achieve the same functions as the resilient rod and the contact part described in the first embodiment, and so will not be repeated herein.

The press structure of the embodiment described above is generally applied to a press type correction tape.

Figure 8:
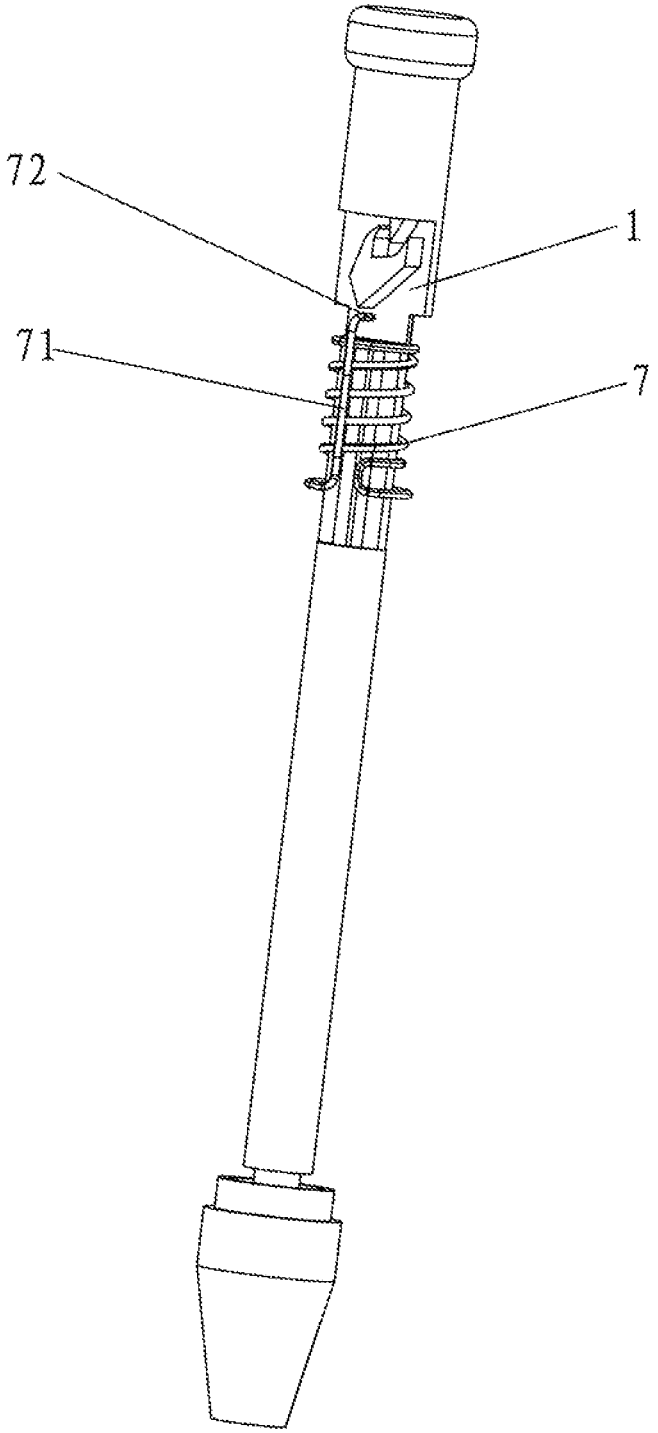
FIG. 8 is a structural view of embodiment 4.
Figure 9:
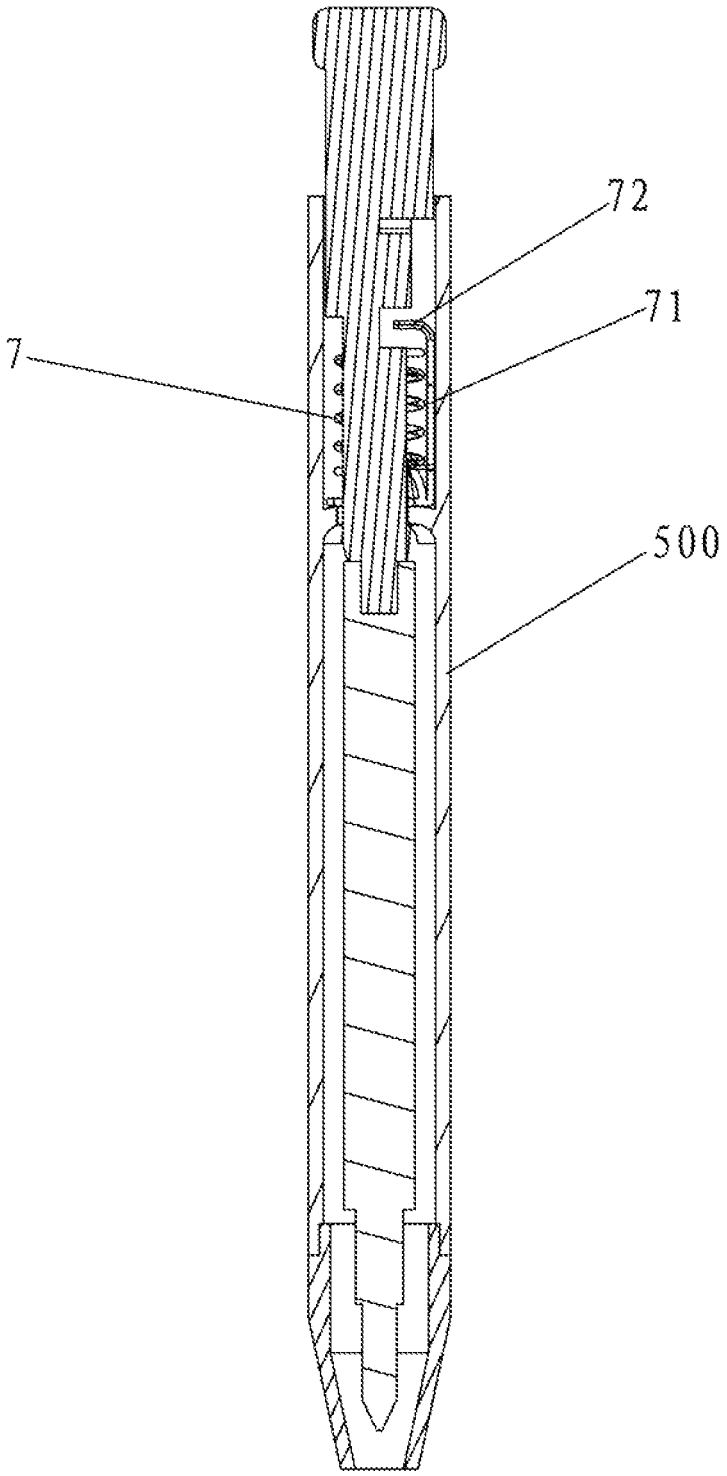
FIG. 9 is a structural view of embodiment 4 applied to a retractable pen.
Figure 10:
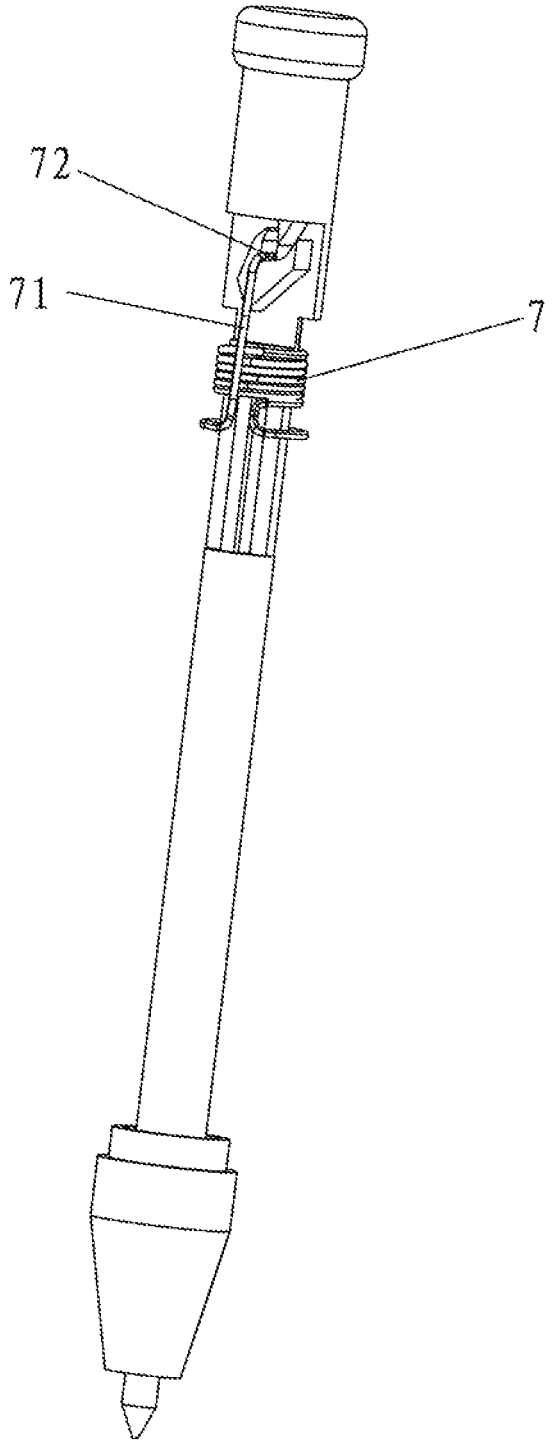
FIG. 10 is a structural view of embodiment 4 in a use condition.

A fourth embodiment of the press structure for press type stationery is shown in FIG. 8 and FIG. 9. The fourth embodiment is different from the first embodiment only with respect to the mounting of the spring. In particular, the spring is also a cylindrical spring 7; the cylindrical spring 7 is positioned below the mounting board 1; end portions of two ends of the cylindrical spring 7 are both positioned at a lower end of the cylindrical spring 7; an end portion of a first end of the cylindrical spring 7 is cooperatively fixed with a stationery housing 500; an inner wall of the stationery housing 500 is outwardly provided with a block (not shown in the figure) on which the end portion of the first end of the cylindrical spring 7 is fixed hooked; an end portion of a second end of the cylindrical spring 7 has an extension arm 71 that extends upwardly; the extension arm is the resilient rod; a transverse rod 72 is formed in one piece with an end portion of an upper end of the extension arm; the transverse rod 72 is perpendicular to the extension arm, and extends along a direction corresponding to the thickness of the mounting board 1; the transverse rod 72 is the contact part. According to this kind of press structure as shown in FIG. 10, when the button is pressed downwardly, the mounting board 1 moves downwardly; downward movement of the mounting board 1 directly compresses the cylindrical spring 7. The cylindrical spring 7 of this embodiment is compressed differently compared with the springs described in the first, second and third embodiments. Apart from this, the cylindrical spring 7 works in the same principle as the springs described in the first, second and third embodiments, and so will not be repeated herein.

The press structure of the embodiment described above is generally applied to a press type retractable pen.

The embodiments and figures shown and described above are not intended to limit the forms and configurations of the invention. Any proper changes or modification made by a person skilled in this field of art should not be considered deviated from the scope of the present invention.

What is claimed is:

1. A press structure for press type stationery, comprising a mounting board, a resilient piece and a button; the mounting board is mounted in a stationery housing and is reciprocally translatable in the stationery housing; the resilient piece is fixedly provided; with reference to a vertical direction along which the mounting board moves up and down, an end portion of an upper end of the mounting board is cooperatively connected with a button; the button partially extends out of the stationery housing; an upper part of a front surface of the mounting board or an upper part of a back surface of the mounting board is recessed to form a recess; a position limiting block is provided in the recess; a closed loop sliding track is formed between outer walls of the position limiting block and inner walls of the recess; a top side of the position limiting block is recessed downwardly to form a position fixing slot; wherein the resilient piece comprises a spring that is vertically deformable along with a downward movement of the mounting board and a resilient rod laterally deformable along with the downward movement of the mounting board; the mounting board is cooperatively connected with the spring in a manner that compression of the spring is controlled along with the downward movement of the mounting board; the resilient rod is upright positioned along the vertical direction; two sides of the position limiting block are provided with a first inclined surface and a second inclined surface respectively; the first inclined surface and the second inclined surface are inclined towards the same side; an end portion of a lower end of the first inclined surface and an end portion of a lower end of the second inclined surface are both positioned at one side of the resilient rod; an upper end of the first inclined surface and an upper end of the second inclined surface are both at another opposite side of the resilient rod; the position fixing slot is positioned between the upper end of the first inclined surface and the upper end of the second inclined surface; an end portion of an upper end of the resilient rod has a contact part; the contact part is positioned inside the sliding track and slidably contacts and cooperates surface-to-surface with the first inclined surface and the second inclined surface as the mounting board moves downwardly.

2. The press structure for press type stationery as in claim 1, wherein the mounting board is provided with a position limiting blocking piece at a top surface of the sliding track; the position limiting blocking piece protrudes downwardly towards the position fixing slot; an end portion of a lower end of the position limiting blocking piece is positioned inside the position fixing slot.

3. The press structure for press type stationery as in claim 2, wherein the position limiting blocking piece has a V shape.

4. The press structure for press type stationery as in claim 1, wherein the spring is a torsion spring; the torsion spring is fixedly mounted on the stationery housing; a pressing block is provided protruding out from the mounting board and positioned above a first arm of the torsion spring; a second arm of the torsion spring extends horizontally along a lateral direction of the mounting board; an end portion of the second arm of the torsion spring is upwardly extended with an extension arm perpendicular to the second arm of the torsion spring; the extension arm is the resilient rod; the contact part is a transverse rod; the transverse rod is positioned at an end portion of an upper end of the extension arm and is perpendicular to the extension arm; the transverse rod extends along a direction corresponding to a thickness of the mounting board.

5. The press structure for press type stationery as in claim 1, wherein the spring is a cylindrical spring; the cylindrical spring extends along the vertical direction of the mounting board; the cylindrical spring is fixedly mounted on the stationery housing; a press block is correspondingly provided on and protruding out from the mounting board; the press block is positioned at an end portion of an upper end of the cylindrical spring; an end portion of a lower end of the cylindrical spring has an upwardly extending extension arm; the extension arm is the resilient rod; the contact part is a transverse rod; the transverse rod is positioned at an end portion of an upper end of the extension arm and is perpendicular to the extension arm; the transverse rod extends along a direction corresponding to a thickness of the mounting board.

6. The press structure for press type stationery as in claim 1, wherein the spring is a cylindrical spring; the cylindrical spring extends along the vertical direction of the mounting board; the cylindrical spring is fixedly mounted on the stationery housing; a press block is correspondingly provided on and protruding out from the mounting board; the press block is positioned at an end portion of an upper end of the cylindrical spring; the resilient rod is a plastic elastic rib extending along the vertical direction of the mounting board; an end portion of a lower end of the plastic elastic rib is fixed on the stationery housing; a contact piece is protruded at an end portion of an upper end of the plastic elastic rib; the contact piece is the contact part; a first guiding inclined surface cooperatively in contact with the first inclined surface and a second guiding inclined surface cooperatively in contact with the second inclined surface are provided on the contact piece.

7. The press structure for press type stationery as in claim 1, wherein the spring is a cylindrical spring; the cylindrical spring is positioned below the mounting board; end portions of two ends of the cylindrical spring are both positioned at a lower end of the cylindrical spring; an end portion of a first end of the cylindrical spring is cooperatively fixed with the stationery housing; an end portion of a second end of the cylindrical spring has an extension arm that extends upwardly; the extension arm is the resilient rod; the contact part is a transverse rod; the transverse rod is formed at an end portion of an upper end of the extension arm; the transverse rod is perpendicular to the extension arm, and extends along a direction corresponding to a thickness of the mounting board.

* * * * *